US008334815B2

(12) United States Patent
Monte et al.

(10) Patent No.: US 8,334,815 B2
(45) Date of Patent: Dec. 18, 2012

(54) MULTI-FEED ANTENNA SYSTEM FOR SATELLITE COMMUNICATIONS

(75) Inventors: Thomas D. Monte, Homer Glen, IL (US); Bosui Liu, Middletown, RI (US); Cory Z. Bousquet, Cranston, RI (US)

(73) Assignee: KVH Industries, Inc., Middletown, RI (US)

( * ) Notice: Subject to any disclaimer, the term of this patent is extended or adjusted under 35 U.S.C. 154(b) by 670 days.

(21) Appl. No.: 12/505,602

(22) Filed: Jul. 20, 2009

(65) Prior Publication Data

US 2011/0012801 A1 Jan. 20, 2011

(51) Int. Cl.
*H01Q 13/00* (2006.01)

(52) U.S. Cl. ..... 343/781 CA; 343/762; 343/781 P

(58) Field of Classification Search ..... 343/762, 343/781 CA, 781 P, 786, 840
See application file for complete search history.

(56) References Cited

U.S. PATENT DOCUMENTS

| | | | | |
|---|---|---|---|---|
| 4,305,075 | A * | 12/1981 | Salvat et al. | 342/78 |
| 4,306,235 | A * | 12/1981 | Christmann | 342/74 |
| 4,599,623 | A * | 7/1986 | Havkin et al. | 343/756 |
| 5,835,057 | A | 11/1998 | van Heyningen et al. | |
| 6,150,899 | A * | 11/2000 | Seewig et al. | 333/126 |
| 6,184,840 | B1 | 2/2001 | Hsin-Loug et al. | |
| 6,512,485 | B2 | 1/2003 | Luly et al. | |
| 6,535,176 | B2 | 3/2003 | Spirtus | |
| 6,680,711 | B2 * | 1/2004 | Desargant et al. | 343/781 CA |
| 6,693,587 | B1 | 2/2004 | Kuether et al. | |
| 6,720,932 | B1 | 4/2004 | Flynn et al. | |
| 6,967,619 | B2 | 11/2005 | Khoo et al. | |
| 7,016,643 | B1 | 3/2006 | Kuether et al. | |
| 7,202,833 | B2 | 4/2007 | Ho et al. | |
| 7,443,355 | B2 | 10/2008 | Griffiths | |
| 2007/0082603 | A1 | 4/2007 | Norin et al. | |
| 2007/0089142 | A1 | 4/2007 | Norin et al. | |
| 2008/0248777 | A1 | 10/2008 | Kits van Heyningen et al. | |

(Continued)

FOREIGN PATENT DOCUMENTS

| | | |
|---|---|---|
| WO | 02073740 | 9/2002 |
| WO | 03058760 | 7/2003 |

OTHER PUBLICATIONS

Hannan, Peter W., "Microwave Antennas Derived from the Cassegrain Telescope." IRE Transactions on Antennas and Propagation, URSI-IRE Spring Metting, Washington , D.C., pp. 140-153 (May 2-5, 1960).

(Continued)

*Primary Examiner* — Tan Ho
(74) *Attorney, Agent, or Firm* — Lowenstein Sandler PC

(57) ABSTRACT

The present invention provides an improved single antenna system that allows reception of RF energy at multiple frequencies. In one embodiment, the antenna is implemented as a multi-beam, multi-feed antenna having a primary reflector fitted with a dual mode feed tube and a switchable LNB that supports both Ka band and Ku band reception. In another embodiment, the antenna is implemented as a multi-beam, multi-feed antenna having a primary reflector fitted with a feed horn and a LNB that is capable of providing movement such that the feed horn with the LNB is at a focal point with the primary reflector for both Ka and Ku band reception. In another embodiment, the antennae is implemented as a multi-beam, multi-feed antenna having a primary reflected fitted with a feed horn assembly and a switchable LNB that supports both Ka band and Ku band reception.

9 Claims, 10 Drawing Sheets

U.S. PATENT DOCUMENTS

2008/0271092 A1 10/2008 Kits van Heyningen et al.
2012/0182195 A1* 7/2012 Monte et al. ..... 343/779

OTHER PUBLICATIONS

Granet, Christophe, "A Simple Procedure for the Design of Classical Displaced-Axis Dual-Reflector Antennas Using a Set of Geometric Parameters." Antenna Designer's Notebook, IEEE Antennas and Propagation Magazine, vol. 41, No. 6, pp. 64-72 (Dec. 1999).

Intellian, "Intellian High Performance Marine Satellite Antenna Systems, d-series The Future of HDTV on boats." specifications and diagram, Intellian Technologies, Inc. (2009).

* cited by examiner

MULTI-FEED ANTENNA SYSTEM FOR SATELLITE COMMUNICATIONS

FIELD OF THE INVENTION

The present invention is generally related to the field of satellite communications and antenna systems, and is more specifically directed to multi-feed antenna systems that allow for reception of RF energy from multiple satellites positioned in several orbital slots broadcasting at multiple frequencies.

BACKGROUND OF THE INVENTION

An increasing number of applications require systems that employ a single antenna designed to receive from and/or transmit RF energy to multiple satellites positioned in several orbital slots broadcasting at multiple frequencies.

On a given single reflector system, a feed (horn or radiating element) is needed for each satellite to be received from (or transmitted to). In cases where the satellites are transmitting different frequency range signals, the antenna dish must change in size and/or shape to reflect enough incident radiated power to a low noise block feed (LNBF) converter such that the signals in different frequency range can be detected and processed by the LNBF. Another option is to provide additional reflector systems to receive and transmit signals of different frequency range. However, both changing the size/and or shape of a single reflector system and/or adding multiple reflector systems at a give location can be difficult and costly.

Currently, there are few solutions in the art that provide for a single antenna system capable of receiving signals from multiple satellites at different frequencies. One such solution is provided in U.S. Patent Publication No. 2008/0271092 to KVH Industries, Inc., in which an apparatus is provided for controlling a satellite antenna to locate a satellite with a desired frequency signal.

Thus, there is a need to provide an improved single antenna system that allows for reception of at least three or more RF signals on a moving platform.

OBJECTS AND SUMMARY OF THE INVENTION

One of the objectives of the present invention is to design an antenna that is capable of receiving or transmitting at least three separate RF signals with orthogonal, linear or circular polarization on a moving platform. This is accomplished by moving an antenna to allow Ku and Ka band frequencies to pass to an LNB converter. The systems described herein allow for a near home experience for a mobile DirecTV user.

In certain embodiments, the present invention is directed to a rear feed antenna system having a dual band Ka/Ku feed with a LNBF assembly having means to switch/move the LNBF between the Ku and Ka LNB ports in the assembly to asynchronously receive Ka, Ku and Ka band signals. An antenna system of this embodiment would comprise, e.g., a primary reflector configured to receive band signals from at least two different satellites; a sub-reflector configured to receive the band signals from the primary reflector; a feed horn assembly configured to receive the band signals from the sub-reflector; a sub-assembly configured to receive and convert the at least two different band signals from the feed horn assembly; and a mechanical actuator configured to align the sub-assembly with the feed horn assembly.

In other embodiments, the present invention is directed to a prime focus Ka/Ku dual band TV receive only antenna system. An antenna system of this embodiment would comprise, e.g., a primary reflector configured to receive band signals from at least two different satellites; a feed horn assembly comprising a first feed horn and a second feed horn, wherein the first and second feed horns are configured to receive the band signals from the primary reflector; and a sub-assembly configured to receive and convert the at least two different band signals from the feed horn assembly.

In certain preferred embodiments of the prime focus system, the Ka-band feed horn is maintained directly on the reflector focus and the Ku-band feed horn is displaced from the focus. Thus, the relative position of the Ka/Ku feed horn assembly (LNBF) is fixed with respect to the main reflector. In other preferred embodiments, the feed horn position is moved with respect to the main reflector.

DETAILED DESCRIPTION OF THE INVENTION

Rear-Focus Systems

Figure 1A:
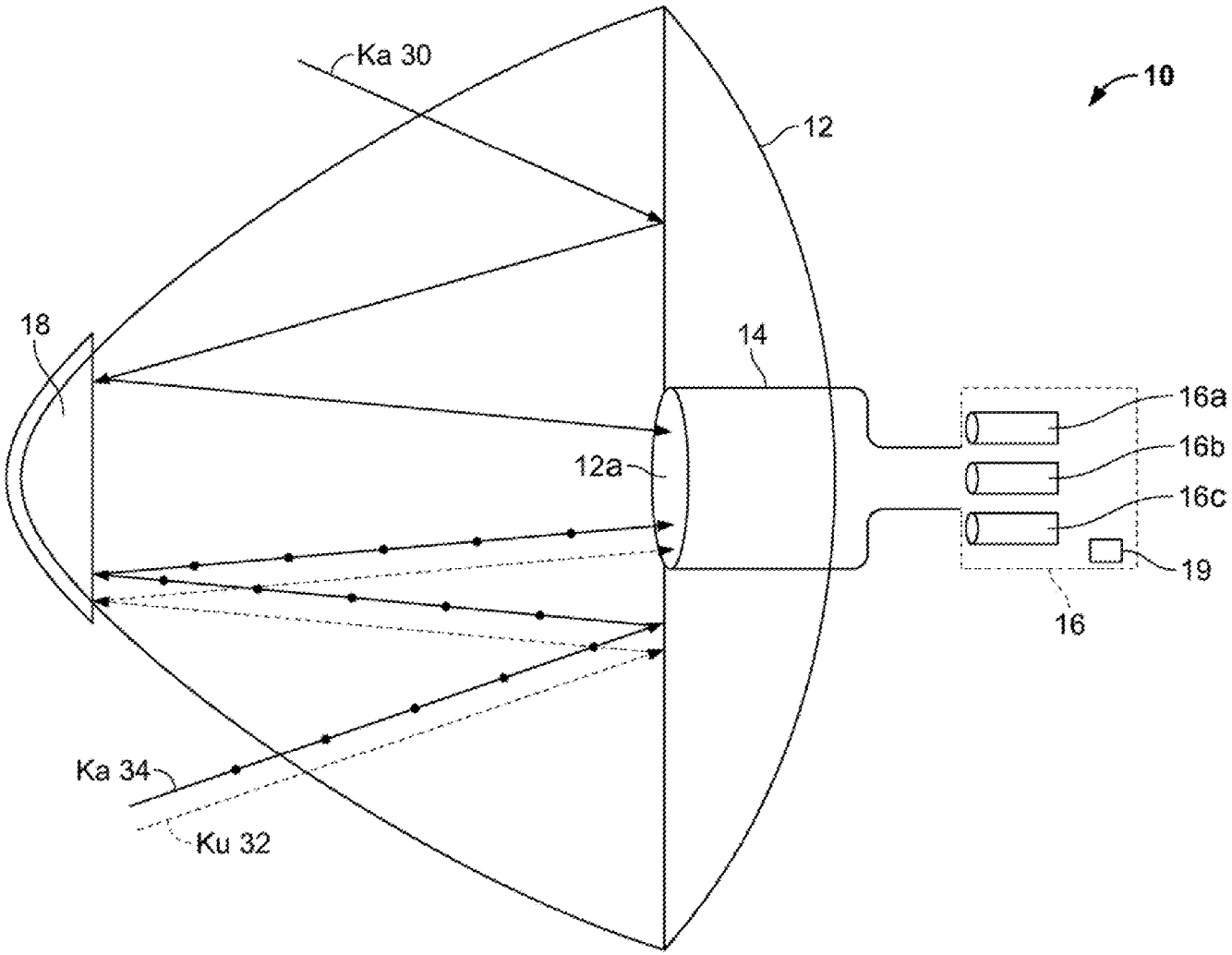
FIG. 1A depicts an embodiment of the present invention wherein the antenna system is a rear-focus system.

Certain embodiments of the present invention provide for a rear feed antenna system having a dual band Ka/Ku feed with a LNBF assembly having means to switch/move the LNBF between the Ku and Ka LNB ports in the assembly to asynchronously receive Ka, Ku and Ka band signals, as shown in FIG. 1A. FIG. 1A illustrates schematic view of a rear focus mobile satellite-antenna system 10 installed on a moving platform (not shown) according to one embodiment of the present invention. The antenna system 10 is preferably an axially symmetrical reflector system. The system 10 includes a primary reflector 12 capable of receiving signals directly from the satellites (not shown). The reflector shown in the present embodiment is a near parabola-shaped reflector and is made of metals such as aluminum or steel, or composite materials, such as carbon loaded fiber. The primary reflector 12 includes an opening 12*a* at its front to accommodate a dual-band feed horn 14 extending from the front to the rear of the reflector 12 as shown in FIG. 1A. The dual-band feed horn 14 is made of aluminum and low loss dielectric material such as, e.g., Rexolite, which is a cross-linked polystyrene, and is connected to the primary reflector 12 preferably via injection molding. As illustrated in FIG. 1A, the primary reflector 12 is coaxially disposed about the dual-band frequency feed horn 14. A sub-assembly 16 preferably a low-noise block (LNB) converter assembly is affixed to one end of the feed horn 14 at the rear of the primary reflector 12 as shown.

The system 10 further includes at least a sub-reflector 18 disposed to face towards the front of the primary reflector 12. Specifically, the front surface of the sub-reflector 18 includes a reflecting surface facing the front surface of the primary reflector 12. In this embodiment, the sub-reflector 18 is an axially displaced ellipse, and relatively small compared to the primary reflector 12. The sub-reflector 18 shares the same axis as the primary reflector 12 and the feed tube 14. As a result, the sub-reflector 18 is positioned to receive and transmit communication signals between the feed tube 14 and the primary reflector 12. The primary reflector 12 is secured to the sub-reflector 18 preferably via support brackets 19 extending between the primary reflector 12 and the sub-reflector 18 as shown.

It is noted that the above described embodiments of the present invention can be used in conjunction with the mounting arrangement of the antenna assembly on a moving platform as disclosed in commonly owned issued U.S. Pat. No. 7,443,355, which is hereby incorporated by reference. It is further noted that optimal efficiency can be achieved by adjusting the geometries of the primary and sub-reflectors, as can be seen in, e.g., Granet C, "A Simple Procedure for the Design of Classical Displaced-Axis Dual-Reflector Antennas Using a Set of Geometric Parameters", *Antennas and Propagation Magazine, IEEE*, Vol. 41 (6), December 1999, pp. 64-72, also incorporated herein by reference.

Figure 1B:
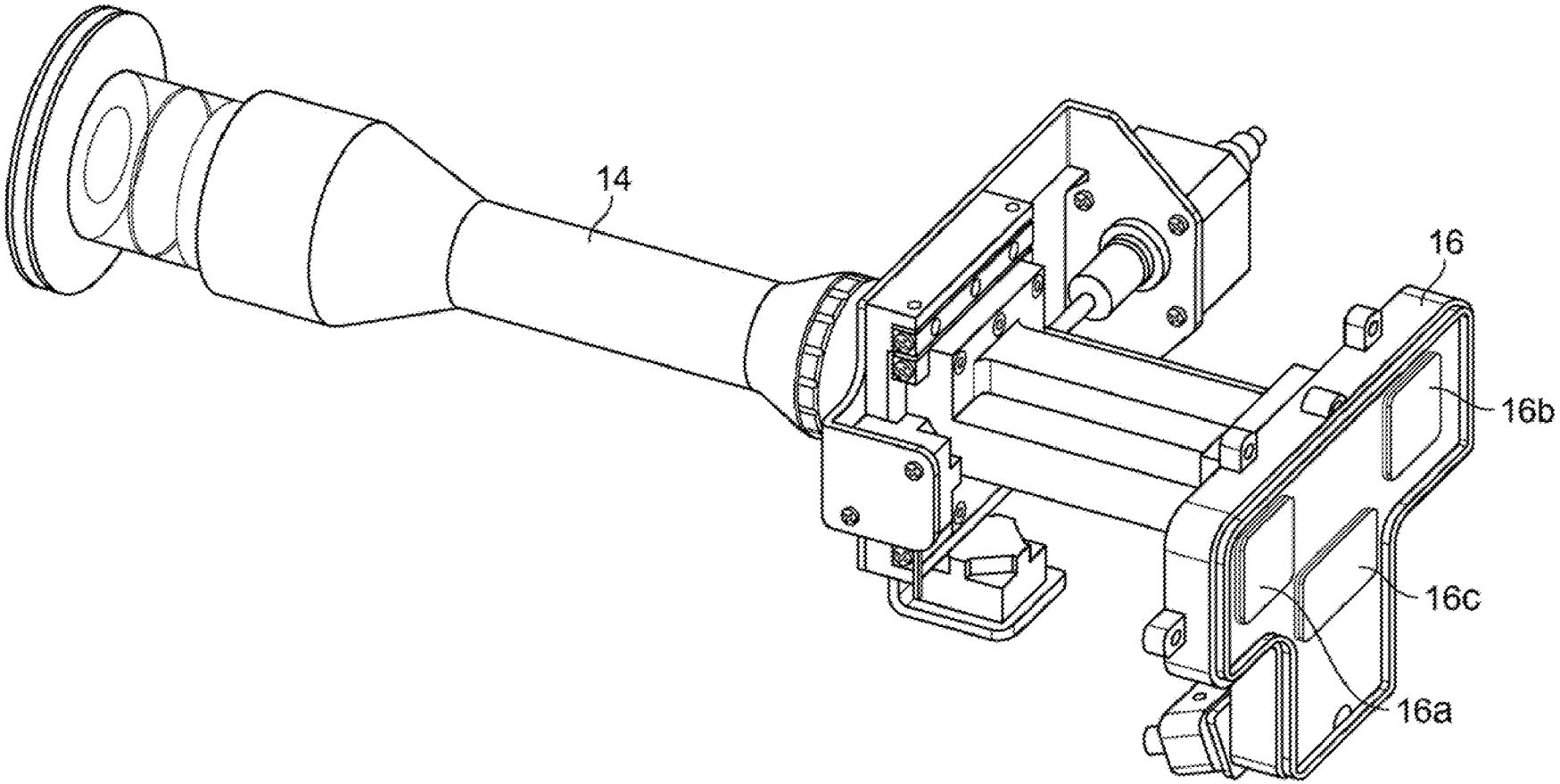
FIG. 1B depicts a side view of the dual-band feed horn and LNB assembly.

FIG. 1B illustrates a side view of the dual-band feed horn 14 connected to the LNB assembly 16 as configured in accordance with a preferred embodiment. The LNB assembly 16 illustrated at FIGS. 1A and 1B preferably comprise three LNBs 16*a*, 16*b* and 16*c*, which are located within the LNB assembly 16 to receive Ka, Ku and Ka band signals respectively. Although three LNBs are shown in FIG. 1, a greater or lesser number of LNBs can be utilized for a given antenna without departing from the scope of the invention.

In general, the system 10 uses different frequency range signals transmitted asynchronously from satellites (not shown) at different orbital locations to be received by the reflector 12 for transmission to the dual-band feed horn 14, which are then forwarded to the appropriate LNB 16 depending on the frequency range of the signal. Each of the LNBs 16 are configured to receive the signals sent by the feed horn 14 and further function to amplify and down convert to a lower frequency band recognized and processed by a Integrator Receiver Decoder (IRD), as will be described in greater detail below.

Figure 1C:
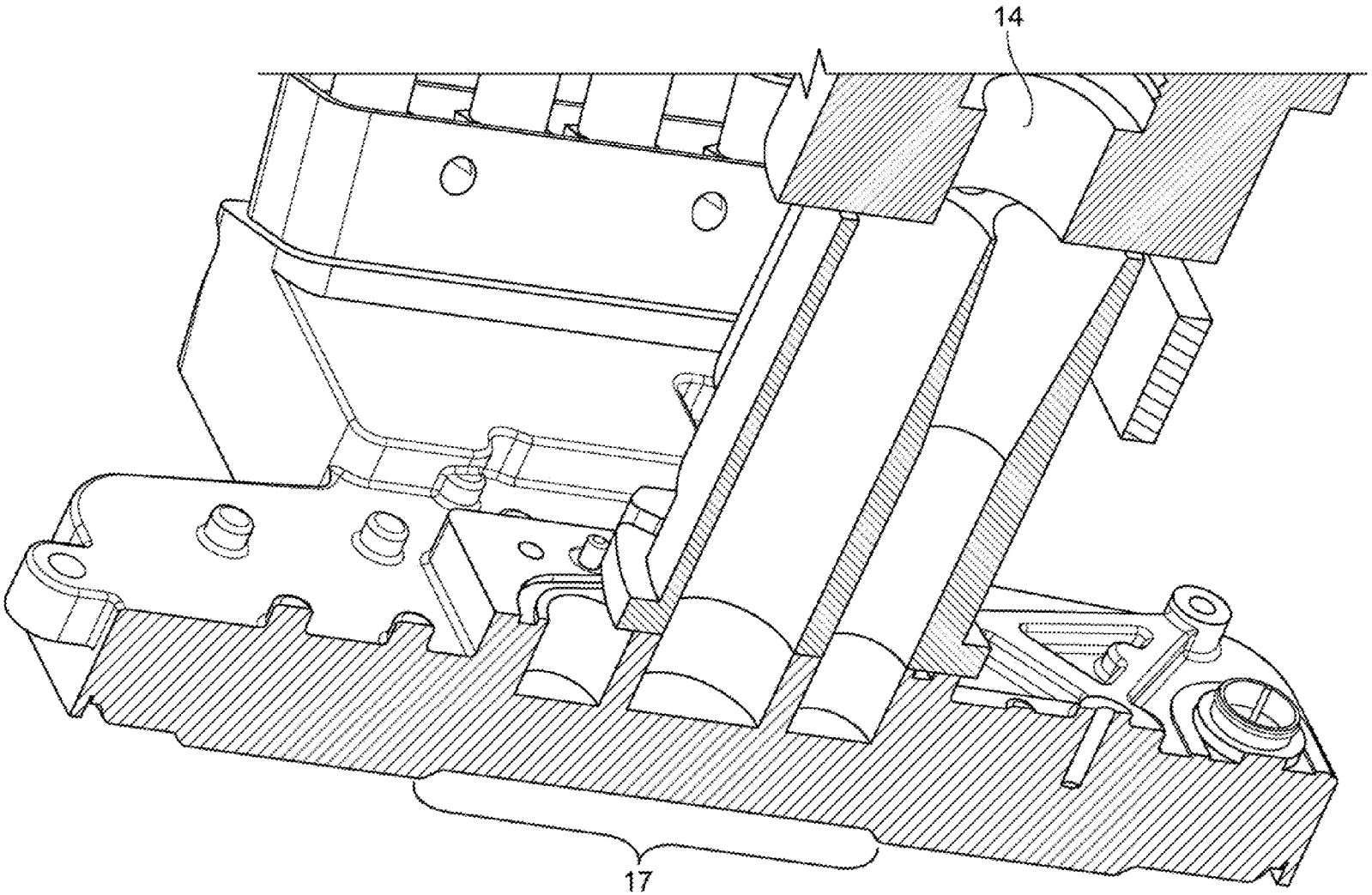
FIG. 1C depicts the waveguide interface at the dual-band feed horn.

The dual-band feed horn 14 operates simultaneously at Ku-band (10.7 to 12.75 GHz) and Ka-band (18.3-18.8 and 19.7-20.2 GHz). The dual band feed horn 14 collects the received signals from the primary reflector 12 and sub-reflector 18, as will be described in further detail below. The received signals from both bands are available at a circular waveguide interface 17, as shown in FIG. 1C. This waveguide interface 17 consists of interface 17*a*, 17*b* and 17*c* which are part of LNBs 16*a*, 16*b* and 16*c* respectively. This common waveguide interface 17 supports both Ku and Ka bands.

Figure 1D:
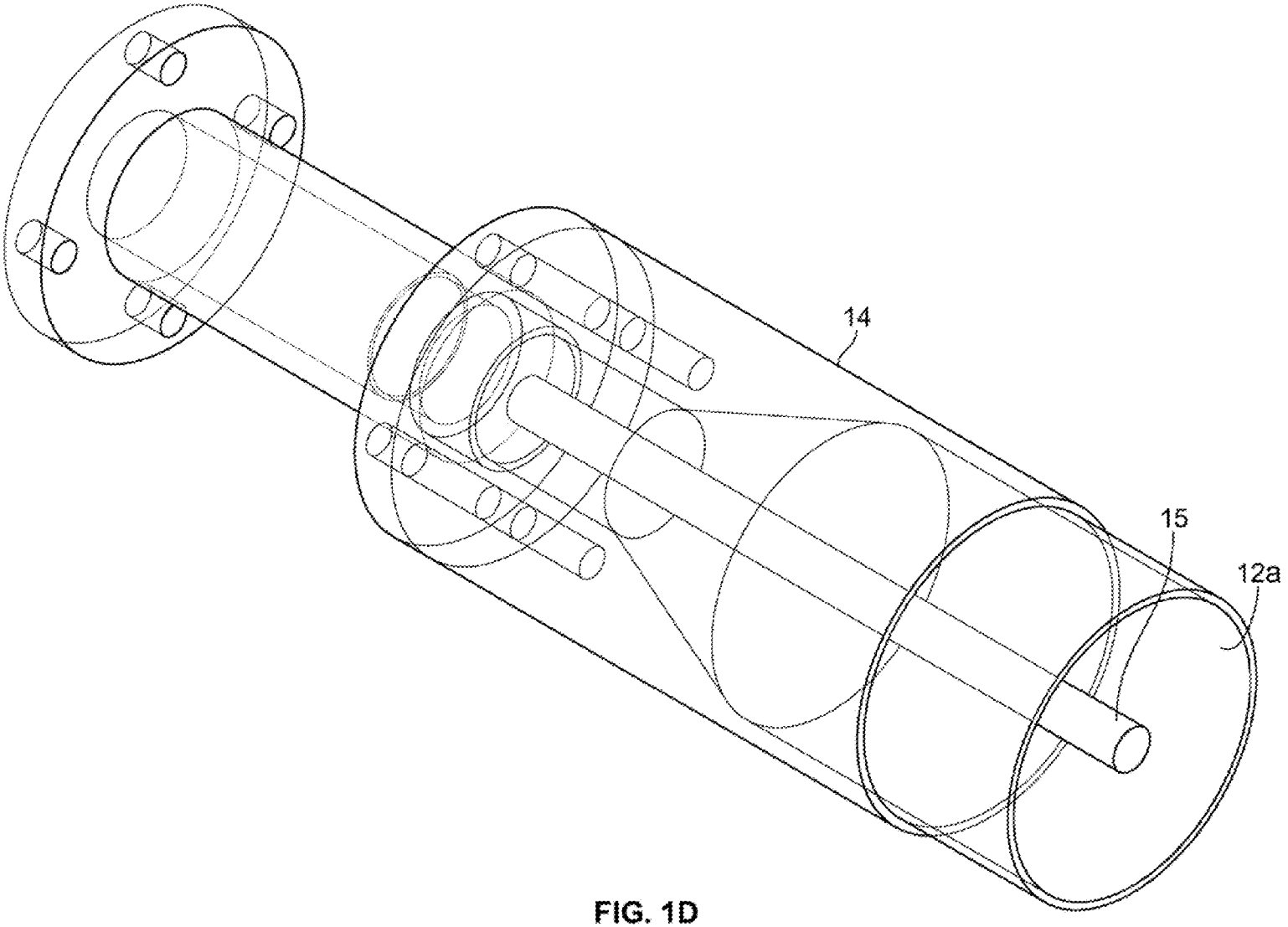
FIG. 1D depicts a side view of the dual-band feed horn containing a dielectric rod.

In alternate embodiments, as shown in FIG. 1D, the cross section of the waveguide at the common interface of the dual-band feed horn 14 includes a co-axially located dielectric rod 15 which is configured to route the band signals to the subassembly 16. The dielectric rod 15 is inserted preferably into the Ku-band feed (not shown) within the feed horn 14 and supports the dominant $HE_{11}$ mode. The rod 15 is appropriately sized for dominate mode operation at Ka-band, and is preferably made from a low loss dielectric material such as, e.g., Rexolite, which is across-linked polystyrene.

The frequency band of operation is selectable based on the band signal received from the satellites. A mechanical motor or actuator 19 as shown in FIG. 1A is preferably-placed in the sub-assembly 16 to provide movement to the sub-assembly 16 such that the appropriate LNB 16*a*, 16*b* and 16*c* is aligned with the feed horn 14 depending upon the frequency band signal received from the satellites. Specifically, each of the waveguide interfaces 17*a*, 17*b* and 17*c* of the LNB 16*a*, 16*b* and 16*c* are aligned with the feed horn 14 to receive their respective band signals. Referring back to FIG. 1A, when Ku-band reception is selected, the waveguide interface 17*b* of the LNB 16*b* is aligned with the feedhorn 14. Likewise when Ka-band reception is selected, the waveguide interface 17*a* or 17*c* of the corresponding Ka-band LNB 16*a* or 16*c* are aligned with the feed horn 14.

More particularly, a first satellite (not shown) located preferably at 101 degrees west longitude delivers a beam 30 in a Ku frequency band of 11 GHz to 12 GHz to the primary reflector 12.

The active surface of the primary reflector 12 reflects this beam signal 30 to the sub-reflector 18. The reflecting surface of sub-reflector 18 in turn reflects the beam signal 30 directly into the feed horn 14. The mechanical actuator 19 causes movement in the LNB 16 such that the LNB 16*b* with its respective waveguide interface 17*b* is aligned with the feed horn 14. A circular waveguide transition (not shown) routes the beam signal 30 between the dual band feed horn 14 and the Ku-band LNB 16*b* via the circular waveguide interface 17*b*. The circular waveguide transition is designed to provide a low reflection path between the partially dielectric loaded circular waveguide and the standard circular waveguide (without partial dielectric loading). The Ku band LNB 16*b* amplifies and down converts the beam signal 30 to a lower frequency band.

A second satellite (not shown) positioned preferably at 99 degrees west longitude delivers a beam 32 in a Ka frequency band of 18 GHz to 20 GHz. The active surface of the primary reflector 12 reflects this beam signal 32 to the sub-reflector 18. The reflecting surface of the sub-reflector 18 in turn reflects the beam 32 to the feed tube 14. The Ka band LNB 16*a* amplifies and down converts the beam signal 32 to a lower frequency band. In one embodiment the Ka beam signal 32 is routed between the dual band feed horn 14 and the Ka-band LNB 16*a* via the circular waveguide interface 17*a* by the mechanical actuator 19 causing a movement to the LNB 16 such that the LNB 16*a* with its respective waveguide interface 17*a* is aligned with the feed horn 14. So, in this embodiment, at the output to the Ka-band transition, a circular waveguide without dielectric loading is provided which matches the circular waveguide diameter of the Ka-band LNB 16*a*. In the alternate embodiments containing a dielectric rod 15 as shown in FIG. 1D, a circular waveguide tapered transition with tapered coaxially supported dielectric rod routes the beam signal 32 into the Ka band LNB 16*a*.

A third satellite (not shown) located preferably at 103 degrees west delivers a beam 34 similar to the beam 32 such that it also contains Ka frequency of 18 GHz to 20 GHz. The active surface of the primary reflector 12 reflects this beam signal 34 to the sub-reflector 18. The reflecting surface of the sub-reflector 18 in turn reflects the beam 32 to the feed tube 14. The feed tube 14 guides this beam signal 34 to directly into the Ka band LNB 16*c*, as described above, which amplifies and down converts the beam signal 34 to a lower frequency band. Similarly as discussed above, in one embodiment the Ka beam signal 34 is routed between the dual band feed horn 14 and the Ka-band LNB 16*c* via the circular waveguide interface 17*c* by the mechanical actuator 19 causing a movement to the LNB 16 such that the LNB 16*c* with its respective waveguide interlace 17*c* is aligned with the feed horn 14. In the alternate embodiments containing a dielectric rod 15 as shown in FIG. 1D, a circular waveguide tapered transition with tapered coaxially supported dielectric rod routes the signal into the Ka band LNB 16*c*.

Prime-Focus Systems

Certain embodiments of the present invention provide for a prime focus Ka/Ku dual band TV receive only antenna system. In such configurations the relative position between the main reflector and the feed horns can be shifted in a variety of ways to seamlessly reconfigure to the new frequency band. For example, in certain embodiments, the feed horn can be transversely displaced. In alternate embodiments, the reflector can be transversely displaced. In yet other embodiments, the tilt angle of the reflector may be altered so that the focus of the reflector is at a particular feed horn. Alternate embodiments provide for the feed horns to be mounted on a mechanical boom in front of the primary reflector, and the angle between the primary reflector Boresite and the boom (i.e., the "boom angle" or "boom tilt") can be adjusted to effectively displace the feed horn position. The feed horns are then aligned with the reflector focus in their respective boom angles.

Figure 2A:
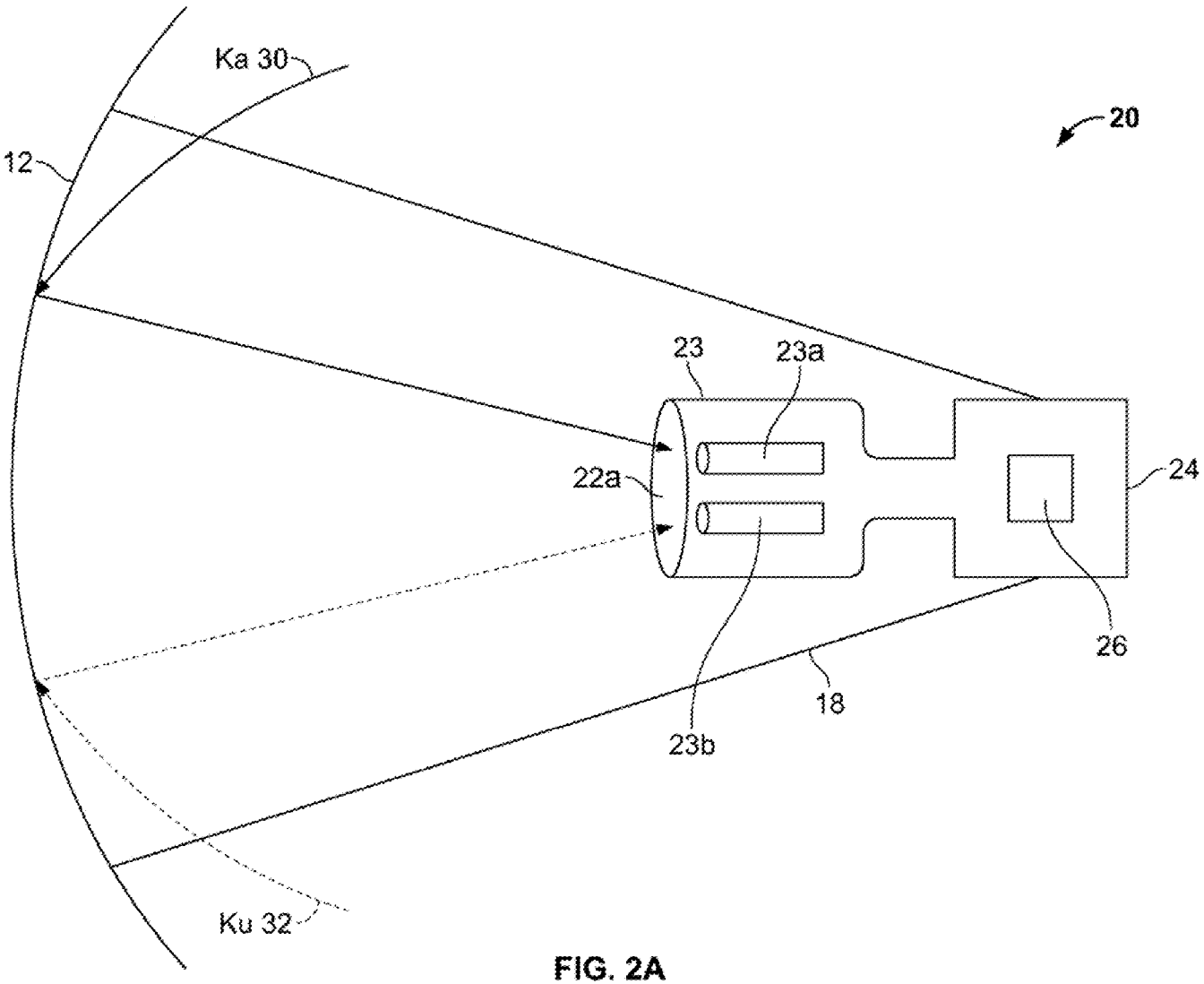
FIG. 2A depicts an embodiment of the present invention wherein the antenna system is a prime focus system.
Figure 2B:
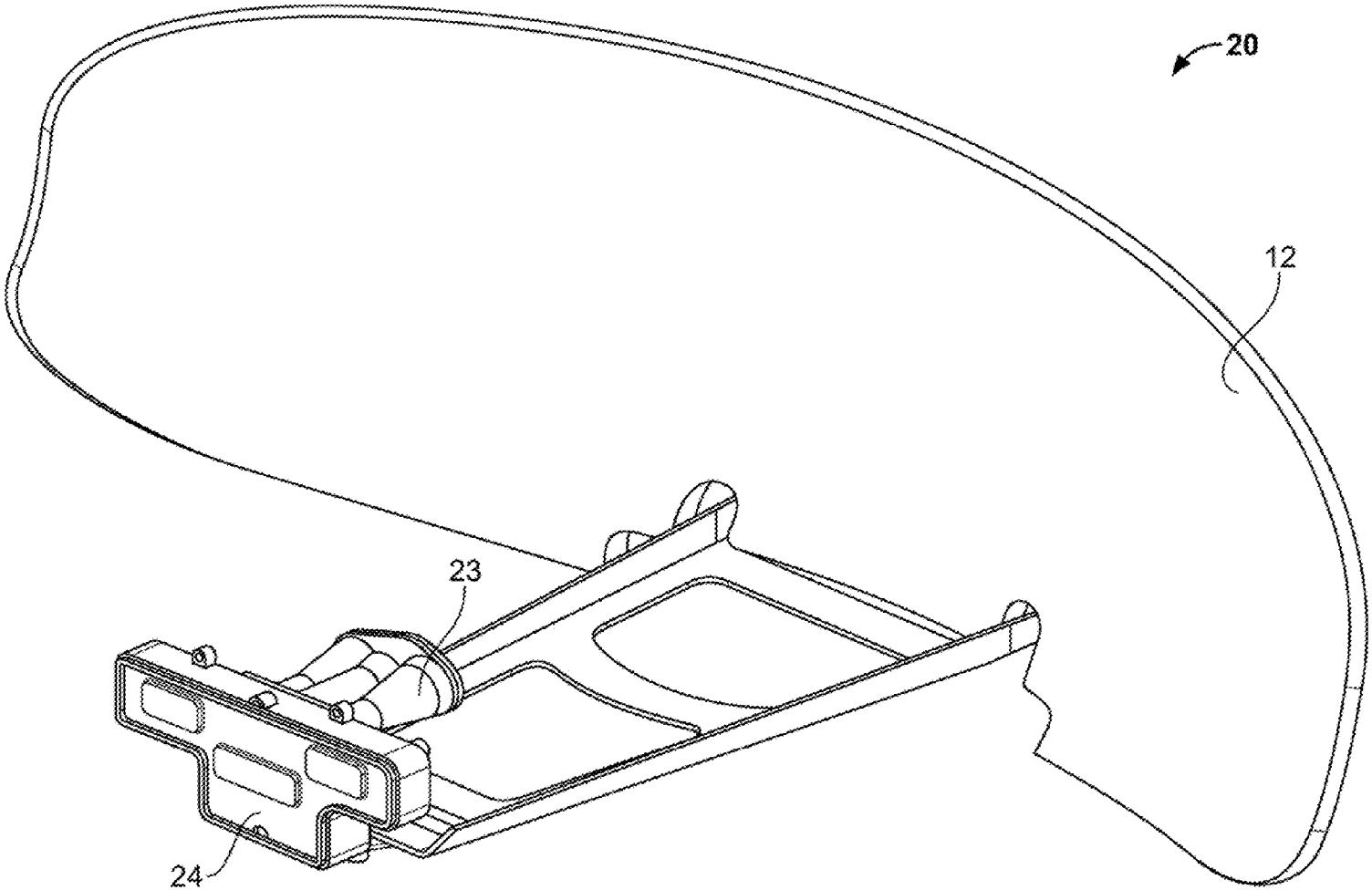
FIG. 2B depicts a front view of the antenna shown in FIG. 2A.

FIG. 2A illustrates schematic view of a prime focus mobile satellite-antenna system 20 installed on a moving platform (not shown) according to another embodiment of the present invention. FIG. 2B illustrate a front view of the antenna 20 as configured in accordance with a preferred embodiment. The antenna system 20 is preferably an offset reflector system. The system 20 includes a primary reflector 12 capable of receiving signals directly from the satellites (not shown). The reflector shown in the present embodiment is a parabola-shaped reflector and is made of metals such as aluminum or steel, or metalized plastic.

The system 20 also includes a feed horn assembly 22 containing at least two feed horns 23*a* and 23*b* operating at the first and second frequency bands. Ku-band and Ka-band respectively, the feed horns having at least two adjacent openings 22*a* at one end and the other end connected to a Low Noise Block (LNB) converter 24. Specifically, the opening ends 22*a* of the feed horns are disposed to face the front surface of the primary reflector 12 as shown. In this embodiment, the feed horn assembly 22 shares the same axis as the primary reflector 12. As a result, the feed horn is positioned to receive and transmit communication signals between the primary reflector 12 and the LNB converter 24. The primary reflector 12 is secured to the combined feed horn and the LNB converter preferably via support brackets 13 for stable mounting.

Figure 2C:
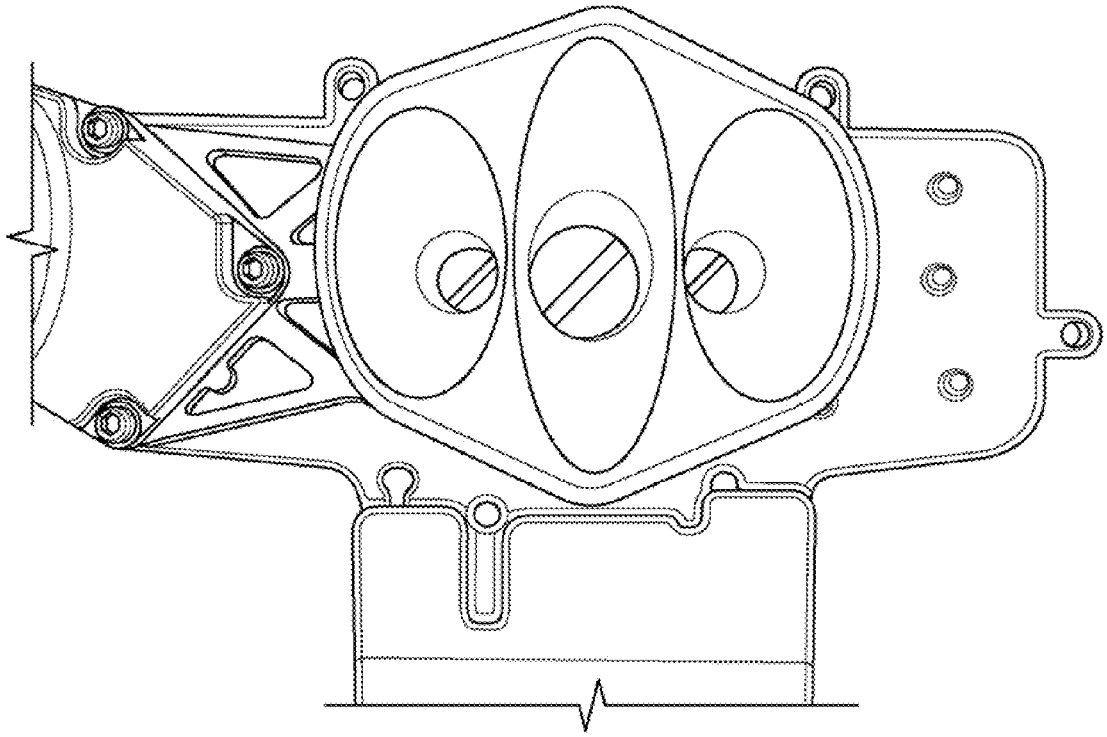
FIG. 2C depicts a feed horn assembly containing three feed horns.
Figure 2C:
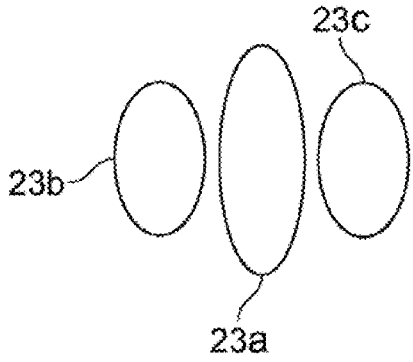

The system 20 is positioned to focus on the bands on either the Ku satellites or the Ka satellites, in a more preferred embodiment, the system 20 includes three feed horns 23*a*, 23*b*, and 23*c*, as depicted in FIG. 2C. In such an embodiment, the feed horns operate at Ka, Ku and Ka bands. The position openings of the feed horns are such that the opening of the higher frequency (Ka-band) feed horn 23*b* or 23*c* is exactly at the focus point of the reflector antenna (not shown). This insures that the highest gain is achieved at Ka-Band. The Ka-band pattern is centered with respect to the reflector (not shown). As a result, the Ku-band feed horn 23*a* is transversely displaced in the focal plane from the optimum focus point of the reflector. This feed offset displaces the Ku-band antenna pattern peak and slightly reduces the available gain. The Ku-band main beam offset is determined by the reflector geometry, including the focal length and reflector focal length to depth ratio, and the feed displacement. The other Ka-band feed not centered at the focal point is not used.

Referring back to FIG. 2A, in a preferred embodiment of the present invention, the system 20 further comprises a standard sized motor 26, e.g., a stepper motor as manufactured by Shinano Kensi Corporation, preferably installed on the LNB converter 24 as shown in FIG. 2A or alternatively separately connected to the LNB 24. The motor 26 functions to provide movement of the LNB feed horn 23, which in turns moves the primary reflector 12 so the feed horn 23 is positioned at the focal point of the primary reflector 12. This way maximum gain is achieved in the antenna 20 as will be described in greater detail below.

Figure 3:
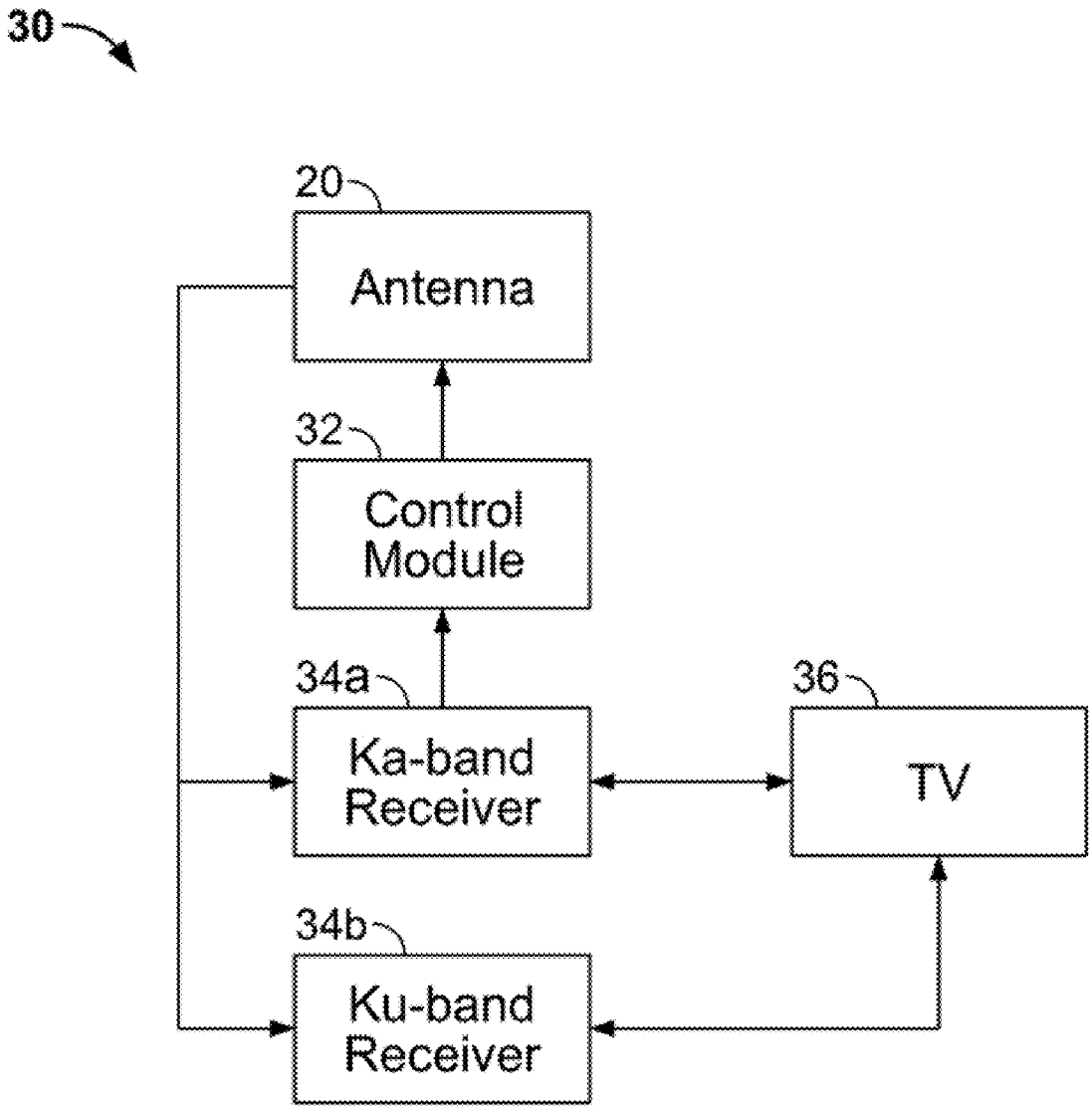
FIG. 3 depicts a flow chart of a mobile satellite communication system implemented to control the movement of the antennas of the present invention.

FIG. 3 depicts one example of a mobile satellite communication system 30 implemented to control the movement of the antenna 20 in accordance with embodiments of the present invention. This system 30 is also installed on the same moving platform (not shown) as the antenna 20. The system 30 includes a control module 32, which receives information from a Ka band receiver 34*a* and Ku band receiver 34*b*. Control module 32 processes information provided by the receivers 34*a* and 34*b* and issues commands to the antenna 30. Receivers 34*a* and 34*b* are preferably an Integrated Receiver Decoders (IRD), which function to decode the Ka and the Ku band signal respectively received from the antenna 20 and produce an output signal that is delivered to the TV 36 via a link such as cable. Note that the signal received by the antenna 20 is an amplified low frequency band signal converted by the LNB converter 24 in the antenna 20. The system 30 as disclosed in the present invention can be used in conjunction with the mobile satellite communication system on a moving vehicle as disclosed in commonly owned issued U.S. Pat. No. 5,835,057 which is hereby incorporated by reference.

The control module 32 preferably includes a processor (not shown) to execute programmed instructions to process information provided by the receiver 32. The processor also functions to execute programmed instructions to issue the command(s) to the antenna 20 to cause the antenna 20 to be directed towards a particular satellite. The movement of the antenna 20 is caused by the commands sent by the control module 32. The commands activate the motor 26 to move the feed horn 23 and the LNB 24 such that the feed horn 23 associated with the desired beam is centered. This embodiment is advantageous, as it does not require the tilt of the antennae to be adjusted. The process as to how the system 30 functions is provided in greater detail below.

If the user wishes to watch something on a Ku band, the user may press a channel on a remote of the TV 36, the signal of which is received by the Ku band receiver 34*b*. This signal includes information on the Ku band based on the channel selected by the user. The receiver 34*b* identifies the satellite that provides the Ku frequency band and sends this information to the control module 32. Alternatively, the control module 32 identifies the satellite that matches with Ku frequency band based on some data stored in a memory (not shown) in the module 32. The control module 32 in turn executes programmed instructions to process this information and issues a command to the antenna 20 to provide the movement of the antenna 20. Specifically, the commands issued by the control module 32 cause the motor 26 to move or slide the feed horn 23 so the reflector 12 points to a satellite (not shown) transmitting the Ku band signal. As a result, the Ku feed horn 23 is centered in order to receive the maximum gain. The maximum gain condition is determined when the feed horn aperture of the requested frequency band is located at the focal point of the reflector. When the satellite transmits Ku band signals 30 to the reflector 12, the active surface of the primary reflector 12 reflects these band signals 30 directly into LNB feed tube 23. The feed horn 23 guides these beam signals 30 directly into the LNB 24, which amplifies and down converts to a lower frequency band. These lower frequency band signals are then sent to the receiver 34*b*, which in turn decodes this signal and produces an output signal that is delivered to the TV 36.

Alternatively, if the user wants to watch something in high definition TV, the user can press another channel on a remote of the TV 36, the signal of which is received by the receiver 34*a*. This signal includes information on a Ka band based on the channel selected by the user. The receiver 34*a* recognizes that a change in the frequency is needed for a transmission for the selected HD channel and further identifies the satellite that provides the Ka frequency band and sends this information to the control module 32. Alternatively, the control module 32 identifies the satellite that matches with Ka frequency band based on some data stored in a memory (not shown) in the module 32. The control module 32 in turn executes programmed instructions to process this information and issues a command to the antenna 20 to provide the movement of the antenna 20. Specifically, the commands issued by the control module 32 cause the motor 26 to move or slide the feed horn 22 so the reflector 12 points to a satellite (not shown) transmitting the Ka band signal. As a result, the feed horn 22 is at the focal point of the primary reflector 12 in order to receive the maximum gain. When the satellite transmits Ka band signals 32 to the reflector 12, the active surface of the primary reflector 12 reflects these band signals 32 directly into LNB feed tube 23. The feed horn 23 guides these beam signals 32 directly into the LNB 24, which amplifies and down converts to a lower frequency band. These lower frequency band signals are then sent to the receiver 34*a*, which in turn decodes this signal and produces an output signal which is delivered to the TV 36.

Figure 4A:
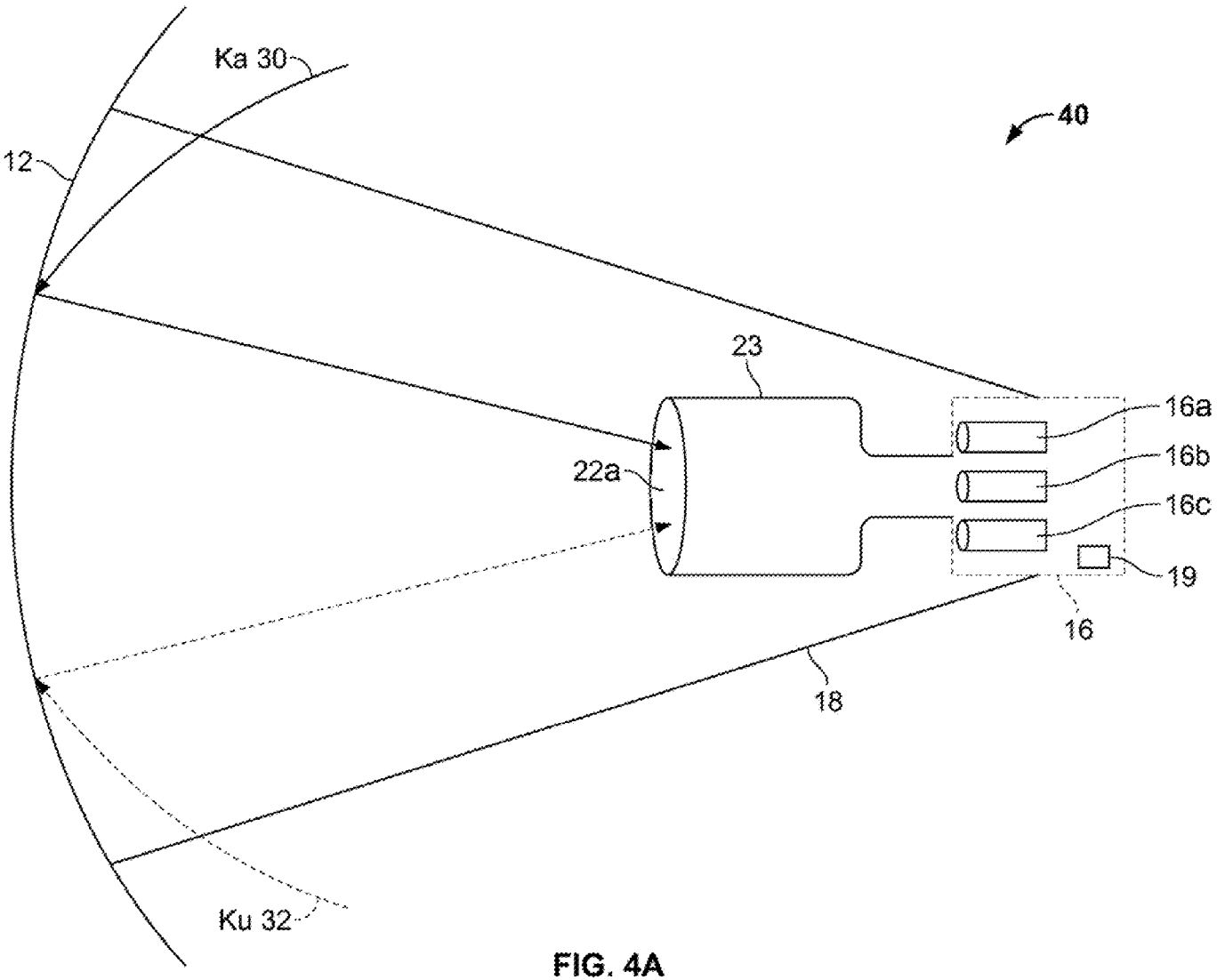
FIG. 4A depicts an alternate embodiment of the present invention wherein the antenna system is a prime focus system.
Figure 4B:
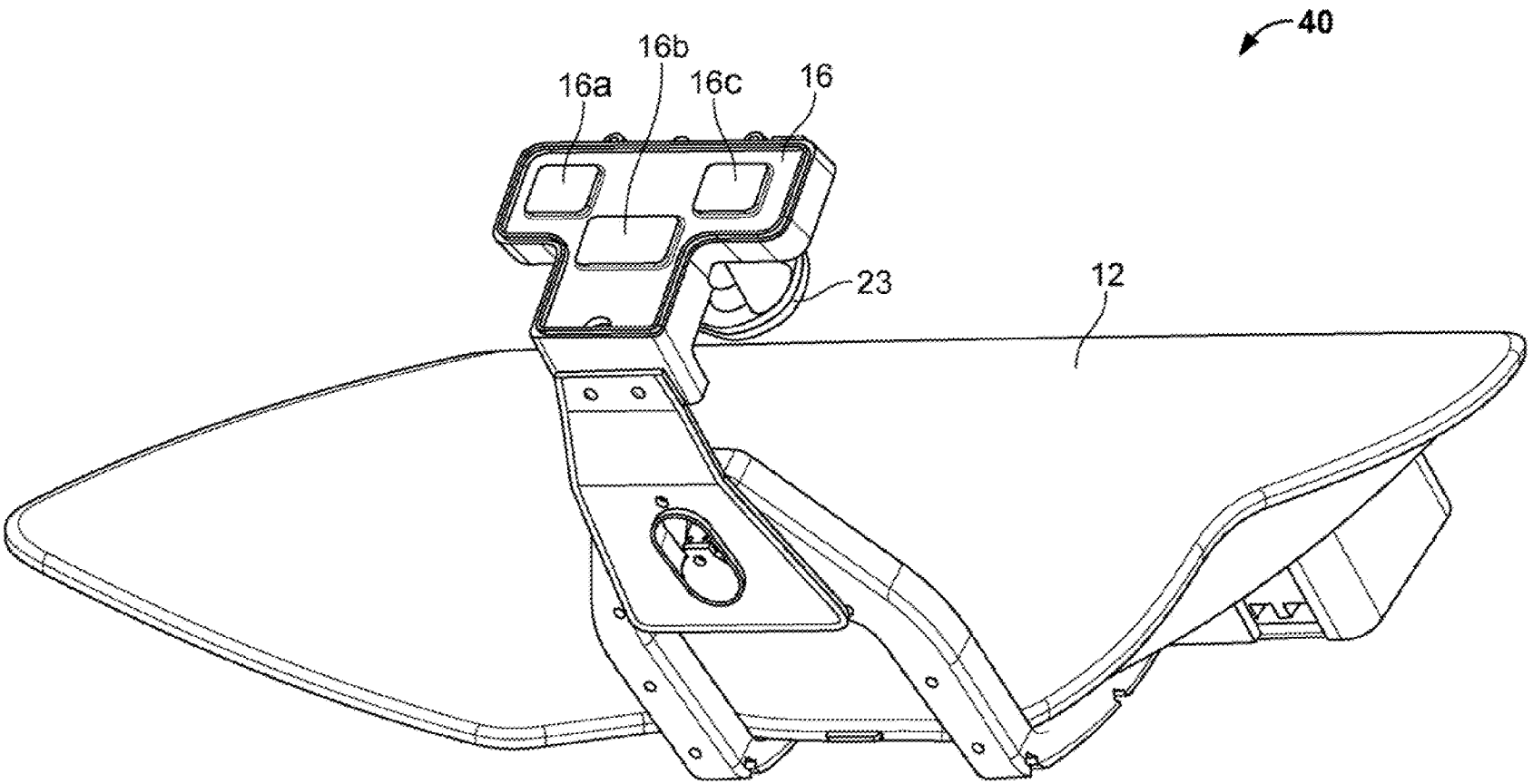
FIG. 4B depicts a rear view of the antenna of FIG. 4A.

FIG. 4A illustrates schematic view of a prime mobile satellite-antenna system 40 installed on a moving platform (not shown) according to an alternate embodiment of the present invention. FIG. 4B illustrate a rear view of the antenna 40 as configured in accordance with a preferred embodiment. As illustrated in FIGS. 4A and 4B, the antenna system 40 is similar to the system 20 except that the LNB converter 24 is replaced by a Low Noise Block (LNB) assembly 16 of FIGS. 1A and 1B. As discussed above, the LNB assembly 16 preferably comprises three LNBs 16*a*, 16*b* and 16*c*, which are located within the LNB assembly 16 to receive Ka, Ku and Ka band signals respectively.

In this embodiment, the feed horn 23 is centered when the user selects programming using the Ku-band signal. When Ka-band signal is selected, the feed is translated in the appropriate direction to maximize the signal, and tracking is converted to Ka-band. When the user selects the Ka-band at the higher/lower frequency than previously selected, the feed is then translated in the opposite direction in order to maximize the Ka-band signal at the selected frequency.

These embodiment provides advantages over the methods of operation described in U.S. Publication No. 2008/0271092, in that if it is determined that the antenna should receive a signal from a second satellite, and that satellite is operating at another frequency band (i.e., Ka-band), the embodiment described above allows for the antenna to reconfigure to the new frequency band in a seamless operation sense for the user. The feed horns, boom tilt or reflector positions can all be translated for selected operation at the Ka/Ku/Ka band positions.

It is noted that the above described embodiments of the present invention can be used in conjunction with the satellite tracking system on a moving vehicle as disclosed in commonly owned issued U.S. Pat. No. 5,835,057 which is hereby incorporated by reference.

While the present invention has been described with respect to what are some embodiments of the invention, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed:

1. An antenna system comprising:

a primary reflector configured to receive and reflect band signals of at least two different frequencies at a focal region located on the primary reflector; said primary reflector having an opening to accommodate at least one feed horn assembly;

a sub-reflector configured to face the focal region of the primary reflector to receive and transmit the band signals to the feed horn assembly;

a sub-assembly aligned with the feed horn assembly and configured to receive and convert the band signals from the feed horn assembly; and a mechanical actuator configured to align the sub-assembly with the feed horn assembly.

2. The antenna system of claim 1, wherein the system is capable of being mounted on a moveable platform.

3. The antenna system of claim 1, wherein the sub-assembly comprises a first and a second conversion assembly configured to receive and convert said band signals of at least two different frequencies.

4. The antenna system of claim 3, wherein the first conversion assembly is configured to receive and convert Ka-band signals of first frequency and the s second conversion assembly is configured to receive and convert Ku-band signals.

5. The antenna system of claim 4, wherein the sub-assembly further comprises a third conversion assembly configured to receive and convert Ka-band signals of a second frequency.

6. The antenna system of claim 5 wherein said third conversion assembly comprising a third waveguide interface to direct the Ka band signals of the second frequency from the feed horn to the third conversion assembly.

7. The antenna system of claim 4 wherein said first conversion assembly comprising a first waveguide interface to direct the Ka band signals of the first frequency from the feed horn to the first conversion assembly.

8. The antenna system of claim 4 wherein said second conversion assembly comprising a second waveguide interface to direct the Ku band signals from the feed horn to the second conversion assembly.

9. The antenna system of claim 1, further comprising a rod positioned within the feed horn assembly and configured to route the band signals to the sub-assembly.

* * * * *